US007624821B1

(12) United States Patent
Hall et al.

(10) Patent No.: US 7,624,821 B1
(45) Date of Patent: Dec. 1, 2009

(54) CONSTRICTING FLOW DIVERTER

(76) Inventors: David R. Hall, 2185 S. Larsen Pkwy., Provo, UT (US) 84606; Scott Dahlgren, 2185 S. Larsen Pkwy., Provo, UT (US) 84606; Jonathan Marshall, 2185 S. Larsen Pkwy., Provo, UT (US) 84606

( * ) Notice: Subject to any disclaimer, the term of this patent is extended or adjusted under 35 U.S.C. 154(b) by 33 days.

(21) Appl. No.: 12/134,442

(22) Filed: Jun. 6, 2008

(51) Int. Cl.
*E21B 10/18* (2006.01)

(52) U.S. Cl. ..... 175/231; 175/242

(58) Field of Classification Search ..... 175/107, 175/231, 242, 317
See application file for complete search history.

(56) References Cited

U.S. PATENT DOCUMENTS

| | | | | |
|---|---|---|---|---|
| RE30,055 | E | 7/1979 | Claycomb | |
| 4,211,291 | A | 7/1980 | Kellner | |
| 4,462,469 | A | 7/1984 | Brown | |
| 4,676,310 | A | 6/1987 | Scherbatskoy | |
| 4,721,172 | A | 1/1988 | Brett | |
| 5,098,258 | A | 3/1992 | Barnetche-Gonzalez | |
| 5,626,200 | A | 5/1997 | Gilbert | |
| 5,839,508 | A | 11/1998 | Tubel | |
| 6,495,929 | B2 | 12/2002 | Bosley | |
| 6,830,107 | B2 * | 12/2004 | Allen | 166/332.4 |
| 6,899,188 | B2 * | 5/2005 | Hughes et al. | 175/57 |
| 7,424,922 | B2 * | 9/2008 | Hall et al. | 175/317 |
| 2003/0066687 | A1 * | 4/2003 | Mitchell | 175/230 |

* cited by examiner

*Primary Examiner*—William P Neuder
(74) *Attorney, Agent, or Firm*—Tyson J. Wilde

(57) ABSTRACT

In one aspect of the present invention, a downhole assembly has a downhole tool string component with a bore adapted to accommodate drilling mud having a central passage and at least one periphery passage. At least two movable segments are peripherally positioned around a bore wall adapted to constrict a diameter of the central passage and are adapted to divert drilling mud into the at least one periphery passage. At least one opening mechanism is adapted to move a portion of the at least two movable segments toward the bore wall.

18 Claims, 8 Drawing Sheets

CONSTRICTING FLOW DIVERTER

BACKGROUND OF THE INVENTION

This invention relates to downhole drilling assemblies, specifically downhole drilling assemblies for use in oil, gas, geothermal, and horizontal drilling. The ability to efficiently provide a power source downhole is desirable to electronically and mechanically power downhole instrumentation.

U.S. Pat. No. 5,626,200 to Gilbert et al., which is herein incorporated by reference for all that it contains discloses a logging-while-drilling tool for use in a wellbore in which a well fluid is circulated into the wellbore through the hollow drill string. In addition to measurement electronics, the tool includes an alternator for providing power to the electronics, and a turbine for driving the alternator. The turbine blades are driven by the well fluid introduced into the hollow drill string. The tool also includes a deflector to deflect a portion of the well fluid away from the turbine blades.

U.S. Pat. No. 5,839,508 to Tubel et al., which is herein incorporated by reference for all that it contains, discloses an electrical generating apparatus which connects to the production tubing. In a preferred embodiment, this apparatus includes a housing having a primary flow passageway in communication with the production tubing. The housing also includes a laterally displaced side passageway communicating with the primary flow passageway such that production fluid passes upwardly towards the surface through the primary and side passageways. A flow diverter may be positioned in the housing to divert a variable amount of the production fluid from the production tubing and into the side passageway. In accordance with an important feature of this invention, an electrical generator is located at least partially in or along the side passageway. The electrical generator generates electricity through the interaction of the flowing production fluid.

U.S. Pat. No. 4,211,291 to Kellner, which is herein incorporated by reference for all it contains, discloses a drill fluid powered hydraulic system used for driving a shaft connected to a drill bit is disclosed. The apparatus includes a hydraulic fluid powered motor actuated and controlled by hydraulic fluid. The hydraulic fluid is supplied to the hydraulic fluid powered motor through an intermediate drive system actuated by drill fluid. The intermediate drive system is provided with two rotary valves and two double sided accumulators. One of the rotary valves routes the hydraulic fluid to and from the accumulators from the drill fluid supply and from the accumulators to the drill bit. The rotary valves are indexed by a gear system and Geneva drive connected to the motor or drill shaft. A heat exchanger is provided to cool the hydraulic fluid. The heat exchanger has one side of the exchange piped between the drill fluid inlet and the drill fluid rotary valve and the other side of the exchange piped between the hydraulic fluid side of the accumulators and the hydraulic fluid rotary valve.

U.S. Pat. No. 4,462,469 to Brown, which is herein incorporated by reference for all that it contains, discloses a motor for driving a rotary drilling bit within a well through which mud is circulated during a drilling operation, with the motor being driven by a secondary fluid which is isolated from the circulating mud but derives energy therefrom to power the motor. A pressure drop in the circulating mud across a choke in the drill string is utilized to cause motion of the secondary fluid through the motor. An instrument which is within the well and develops data to be transmitted to the surface of the earth controls the actuation of the motor between different operation conditions in correspondence with data signals produced by the instrument, and the resulting variations in torque in the drill string and/or the variations in torque in the drill string and/or the variations in circulating fluid pressure are sensed at the surface of the earth to control and produce a readout representative of the down hole data.

U.S. Pat. No. 5,098,258 to Barnetche-Gonzalez, which is herein incorporated by reference for all that it contains, discloses a multistage drag turbine assembly is provided for use in a downhole motor, the drag turbine assembly comprising an outer sleeve and a central shaft positioned within the outer sleeve, the central shaft having a hollow center and a divider means extending longitudinally in the hollow center for forming first and second longitudinal channels therein. A stator is mounted on the shaft. The stator has a hub surrounding the shaft and a seal member fixed to the hub wherein the hub and the shaft each have first and second slot openings therein. A rotor comprising a rotor rim and a plurality of turbine blades mounted on the rotor rim is positioned within the outer sleeve for rotation therewith respect to the stator such that a flow channel is formed in the outer sleeve between the turbine blades and the stator. A flow path is formed in the turbine assembly such that fluid flows though the turbine assembly flows through the first longitudinal channel in the central shaft, through the first slot openings in the shaft and the stator hub, through the flow channel wherein the fluid contacts the edges of the turbine blades for causing a drag force thereon, and then through the second slot openings in the stator hub and the shaft into the second channel.

BRIEF SUMMARY OF THE INVENTION

In one aspect of the present invention, a downhole assembly has a downhole tool string component with a bore adapted to accommodate drilling mud having a central passage and at least one periphery passage. At least two movable segments are peripherally positioned around a bore wall adapted to constrict a diameter of the central passage and are adapted to divert drilling mud into the at least one periphery passage. At least one opening mechanism is adapted to move a portion of the at least two movable segments toward the bore wall.

The at least one periphery passage may direct drilling mud to a turbine. The turbine may be in communication with an electrical generator. The at least one periphery passage may direct drilling mud to a downhole hammer, a downhole steering tool, sensors, or combinations thereof.

The at least one opening mechanism may comprises a motor, a spring, a pin, a hydraulic actuator, or combinations thereof. The at least two movable segments may be interlocked. Springs may connect the at least two movable segments together. The at least two movable segments may be foils. The at least two movable segments may have a forward tapered face. The at least two movable segments may have a rearward tapered face. An edge of the at least two movable segments may taper from a bottom end of the at least two movable segments to a top end of the at least two movable segments.

The at least two movable segments may be adapted to pivot on the opening mechanism. The at least two movable segments may be adapted to pivot on a stator disposed within the bore. The at least two movable segments may be adapted to pivot on a wall of the at least one periphery passage. A turbine body disposed within the bore and the at least two movable segments may form a barrier separating the central passage and the at least one periphery passage. The bore may have an expanded diameter region. The downhole assembly may be in communication with a telemetry system.

DETAILED DESCRIPTION OF THE INVENTION AND THE PREFERRED EMBODIMENT

Figure 1:
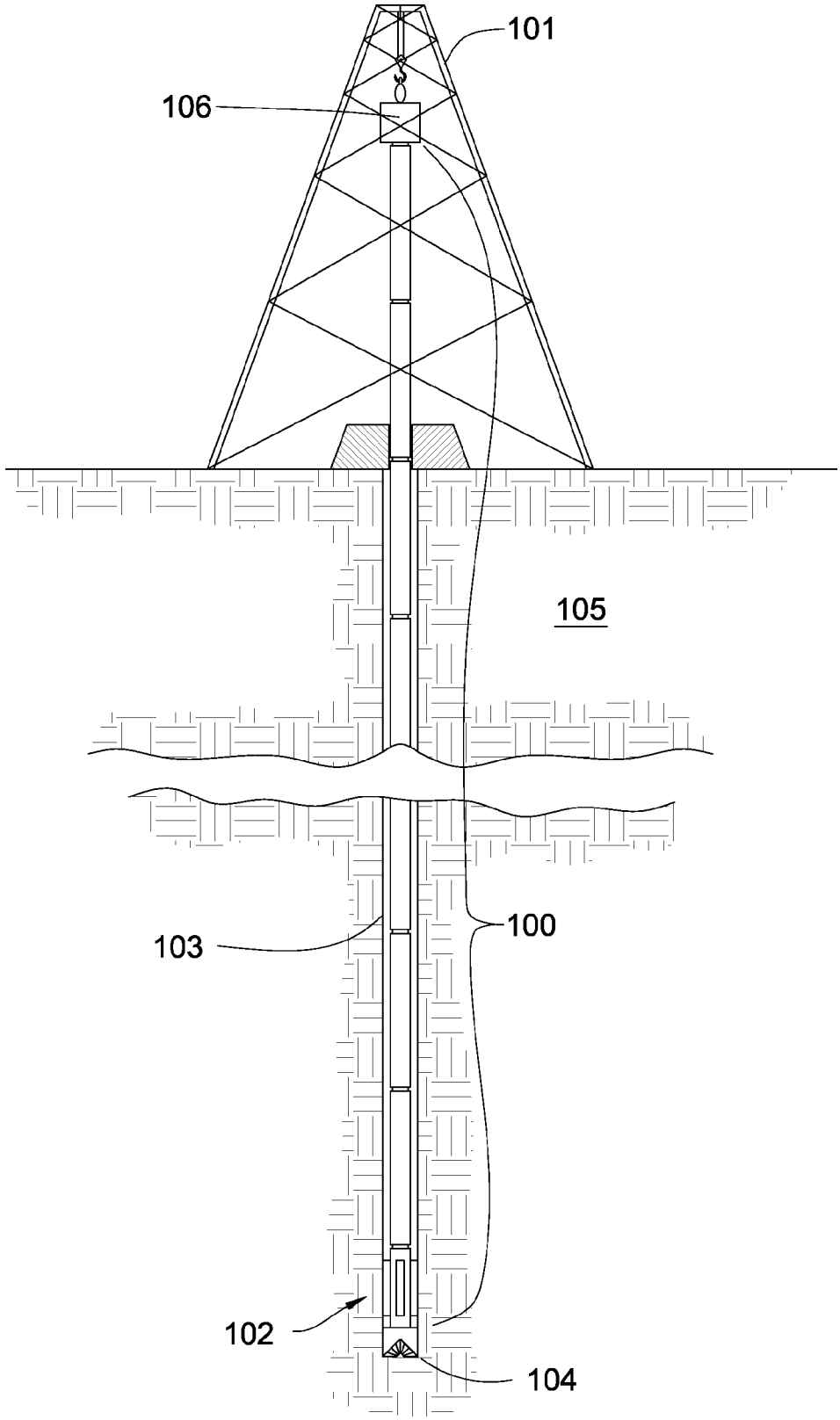
FIG. 1 is a cross-sectional diagram of an embodiment of a drill string suspended in a bore hole.

FIG. 1 is an embodiment of a drill string 100 suspended by a derrick 101. A downhole assembly 102 is located at the bottom of a bore hole 103 and comprises a drill bit 104. As the drill bit 104 rotates downhole the drill string 100 advances farther into the earth. The drill string 100 may penetrate soft or hard subterranean formations 105. The downhole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the downhole assembly 102.

Figure 2:
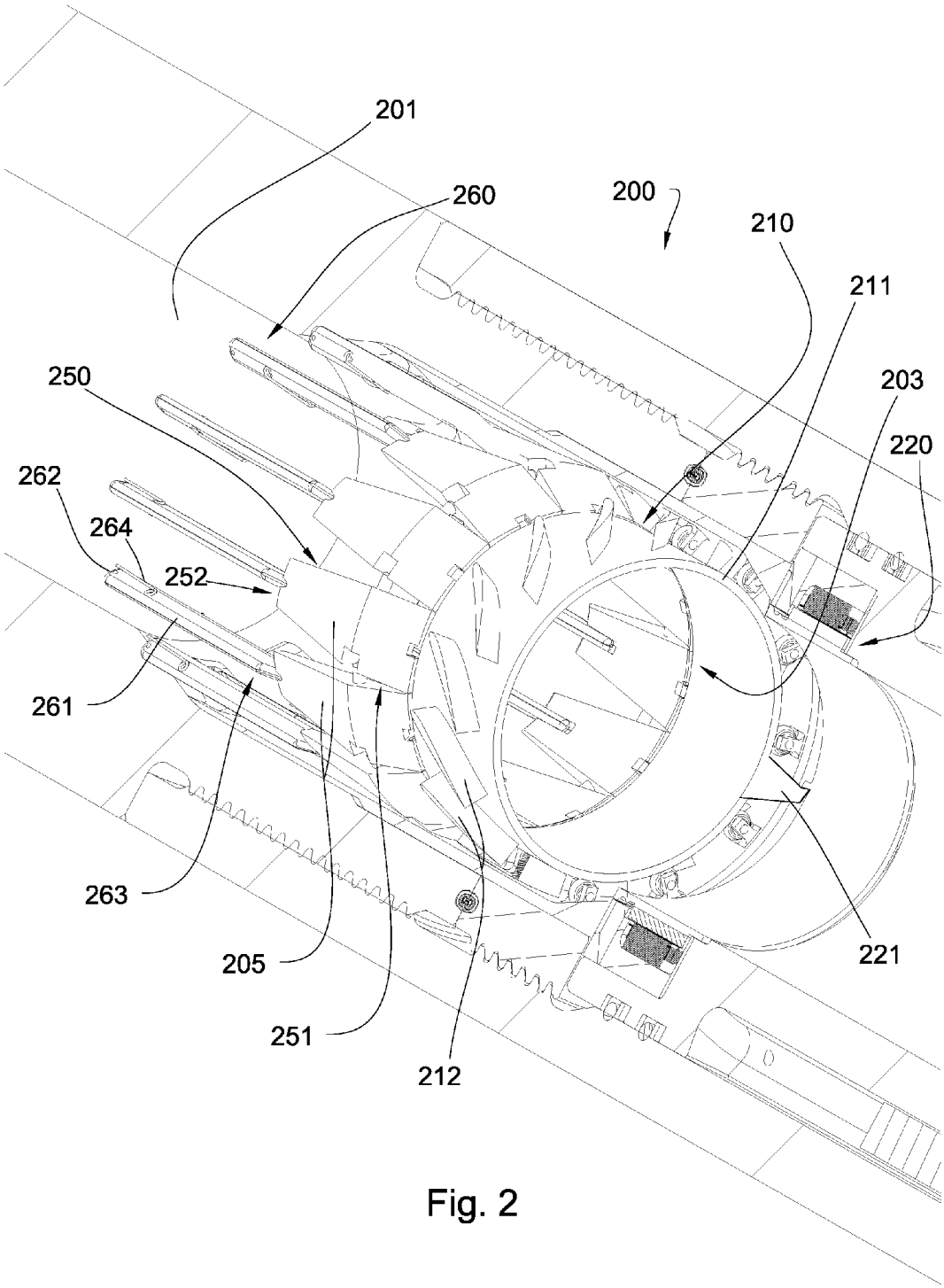
FIG. 2 is a cross-sectional diagram of an embodiment of a downhole tool string component.
Figure 3A:
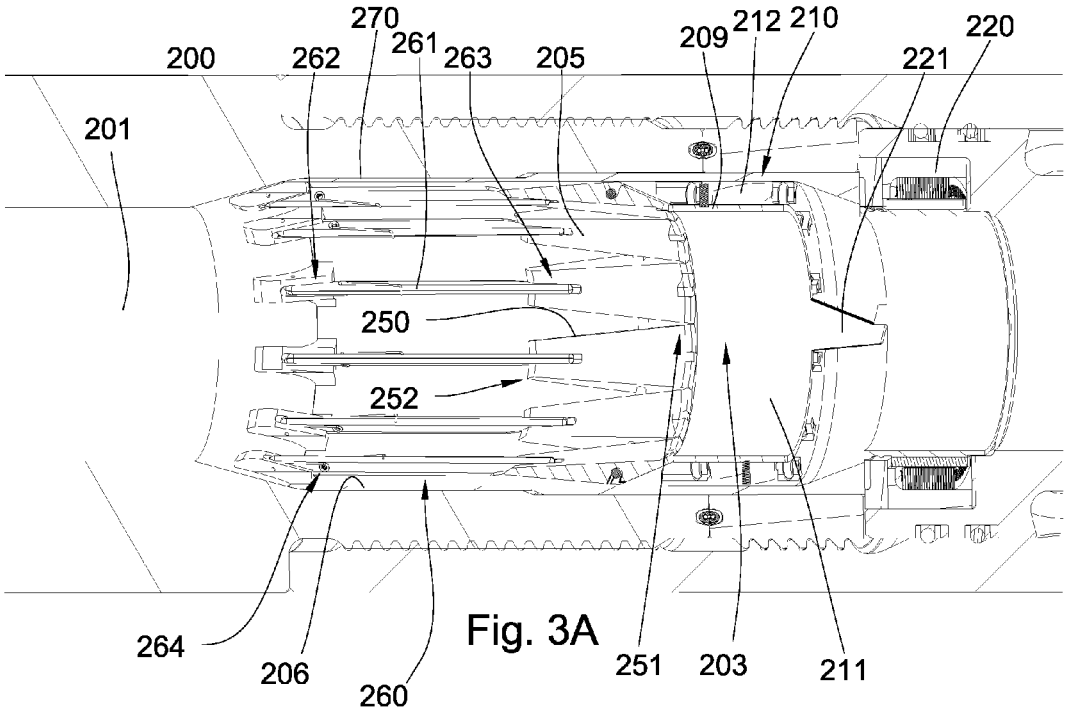
FIG. 3*a* is a cross-sectional diagram of another embodiment of the downhole tool string component in the opened position.
Figure 3B:
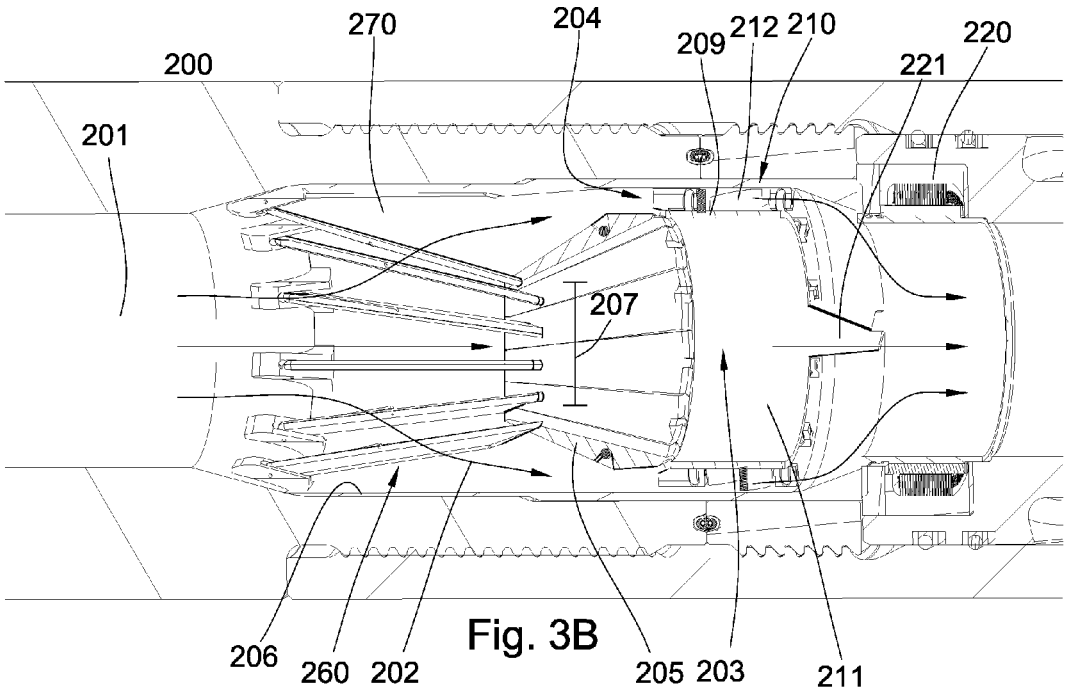
FIG. 3*b* is a cross-sectional diagram of another embodiment of the downhole tool string component in the closed position.

Referring now to FIGS. 2 through 3*b*, the downhole assembly 102 comprises a downhole tool string component 200 comprising a bore 201 adapted to accommodate drilling mud 202. The bore 201 comprises a central passage 203 and at least one periphery passage 204. The at least one periphery passage 204 may direct drilling mud 202 to a turbine 210. At least two movable segments 205 are disposed within the bore 201 and are peripherally positioned around a bore wall 206. The at least two movable segments 205 are adapted to constrict a diameter 207 of the central passage 203 and are adapted to divert drilling mud 202 into the at least one periphery passage 204. In the embodiment of FIGS. 3*a* through 3*b* the at least two movable segments 205 may be adapted to pivot on a wall 208 of the at least one periphery passage 204. An edge 250 of the at least two movable segments 205 may taper from a bottom end 251 of the at least two movable segments 205 to a top end 252 of the at least two movable segments 205. The at least two movable segments 205 may be foils 205. It is believed that as drilling mud 202 flows through the bore a pressure drop may develop and the top ends 252 of the at least two movable segments 205 will move towards the center of the bore 201. It is anticipated that as the top ends 252 of the at least two movable segments 205 move towards the center of the bore 201, the tapered edges 250 of the at least two movable segments 205 may abut one with another preventing the top ends 252 of the at least two movable segments 205 from advancing further towards the center of the bore 201. The downhole tool string component 200 is considered to be in a closed position when the top ends 252 of the at least two movable segments 205 can no longer advance further towards the center of the bore 201. When the downhole tool string component 200 is in the closed position the at least two movable segments 205 constrict the diameter 207 of the central passage 203 and divert drilling mud 202 into the at least one periphery passage 204.

The downhole tool string component 200 comprises at least one opening mechanism 260 adapted to move a portion of the at least two movable segments 205 toward the bore wall 206. In the embodiment of FIGS. 3*a* through 3*b*, the at least one opening mechanism 260 may comprise at least one pin 261 with a first end 262 and a second end 263. The first end 262 may be connected to the bore wall 206 and adapted to pivot. A spring 264 may be used to apply a force on the pin 261 pushing the pin towards the bore wall 206. As the spring 264 pushes the pin 261 in the direction of the bore wall 206 the second end 263 of the pin 261 may contact one of the at least two movable segments 205 and move the top end 252 of the contacted movable segment 205 toward the bore wall 206. The downhole tool string component 200 is considered to be in an opened position when the top ends 252 of the at least two movable segments 205 are positioned proximate the bore wall 206 the diameter 207 of the central passage 203 is not constricted. The spring 264 may exert a force strong enough to keep the at least two movable segments 205 in the opened position when drilling mud 202 is not flowing through the bore 201 and weak enough to allow the at least two movable segments 205 to move to the closed position when drilling mud 202 is flowing through the bore 201. The embodiment of FIGS. 3*a* through 3*b* may comprise as many pins 261 and springs 264 as there are movable segments 205 and may comprise as few as one pin 261 and one spring 264. The at least two movable segments 205 may be interlocked such that if one of the at least movable segments 205 is moved towards the bore wall 206 the rest of the at least two segments 205 are also moved towards the bore wall 206. It is believed that the interlocked movable segments 205 may be beneficial when instruments from the surface are passed down the center of the drill string 100 and as the instruments approach the at least two movable segments 205 the instruments will contact at least one of the pins 261 forcing all of the at least two movable segments 205 to the opened position if they are not already in the opened position. The at least two movable segments 205 may close the at least one periphery passage 204 when in the opened position preventing drilling mud 202 from entering the at least one periphery passage 204.

In the embodiment of FIGS. 3*a* and 3*b*, a turbine body 211 and the at least two movable segments 205 may form a barrier 209 separating the central passage 203 and the at least one periphery passage 204. Turbine blades 212 may be connected to the turbine body 211 and disposed within the at least one periphery passage 204. The turbine 210 may be in communication with an electrical generator 220. The turbine 210 may transfer mechanical energy to the electrical generator 220 via a connecting rod 221 disposed intermediate the turbine 210 and the electrical generator 220. The bore 201 may comprise an expanded diameter region 270 adapted to accommodate the turbine 210, the electrical generator 220, the at least two movable segments 205, and the at least one periphery passage 204.

Figure 4A:
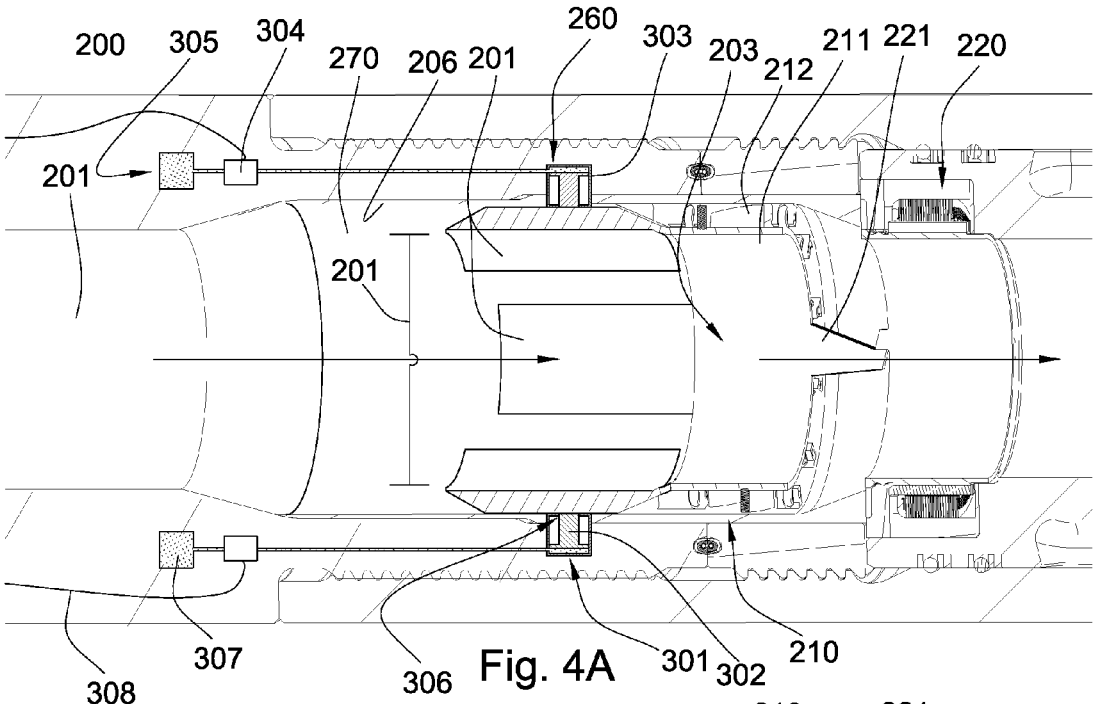
FIG. 4*a* is a cross-sectional diagram of another embodiment of the downhole tool string component in the opened position.
Figure 4B:
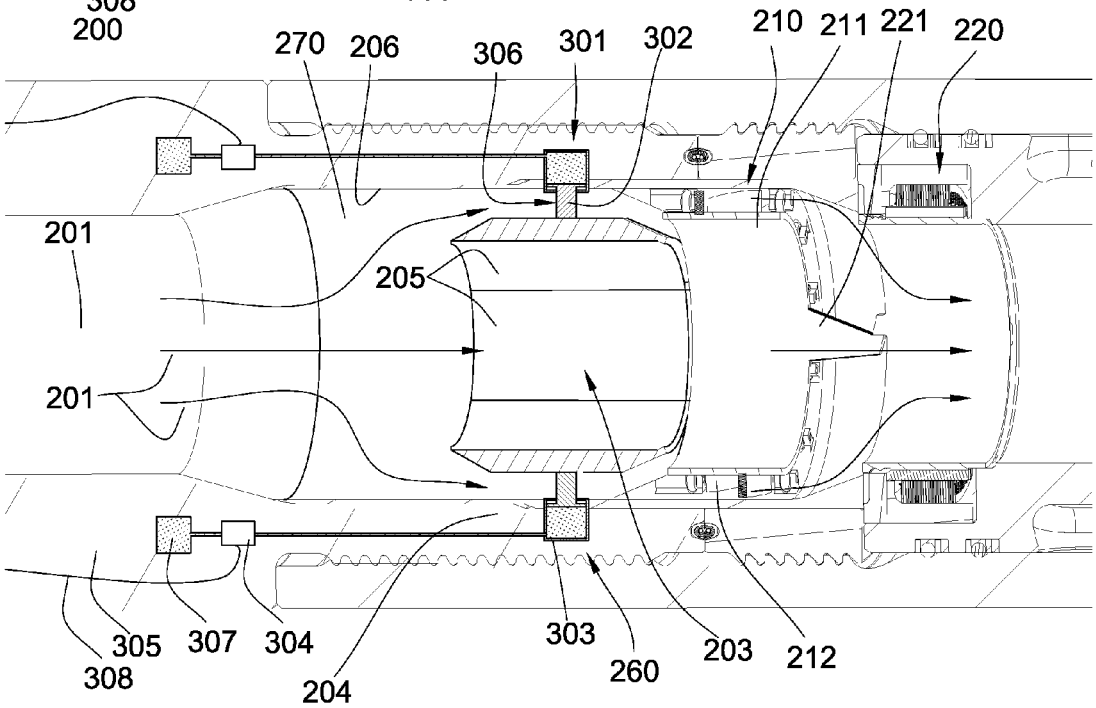
FIG. 4*b* is a cross-sectional diagram of another embodiment of the downhole tool string component in the closed position.

FIGS. 4*a* through 4*b* disclose an embodiment wherein the at least one opening mechanism 260 may comprise an actuator 301. In some embodiments, the actuator may be a hydraulic actuator. The actuator 301 may comprise a piston 302 disposed in a piston housing 303 located within the bore wall 206. A distal end 306 of the piston 302 is in communication with the at least two movable segments 205. A pump 304 may be in communication with the piston housing 303 and may direct hydraulic fluid 307 from a fluid reservoir 305 to the piston housing 303 and the pump 304 may direct hydraulic fluid 307 from the piston housing 303 to the fluid reservoir 305. As hydraulic fluid 307 is directed to the piston housing 303 the piston 302 may move the at least two movable segments 205 into the closed position. As hydraulic fluid 307 is directed from the piston housing 303 to the fluid reservoir 305 the piston 302 may move the at least two movable segments 205 into the opened position. A telemetry system 308 may be in communication with the downhole assembly 102 and may be used to control the opening mechanism 260. In the embodiment of FIGS. 4*a* through 4*b*, the telemetry system 308 may be used to control the pump 304.

Figure 5A:
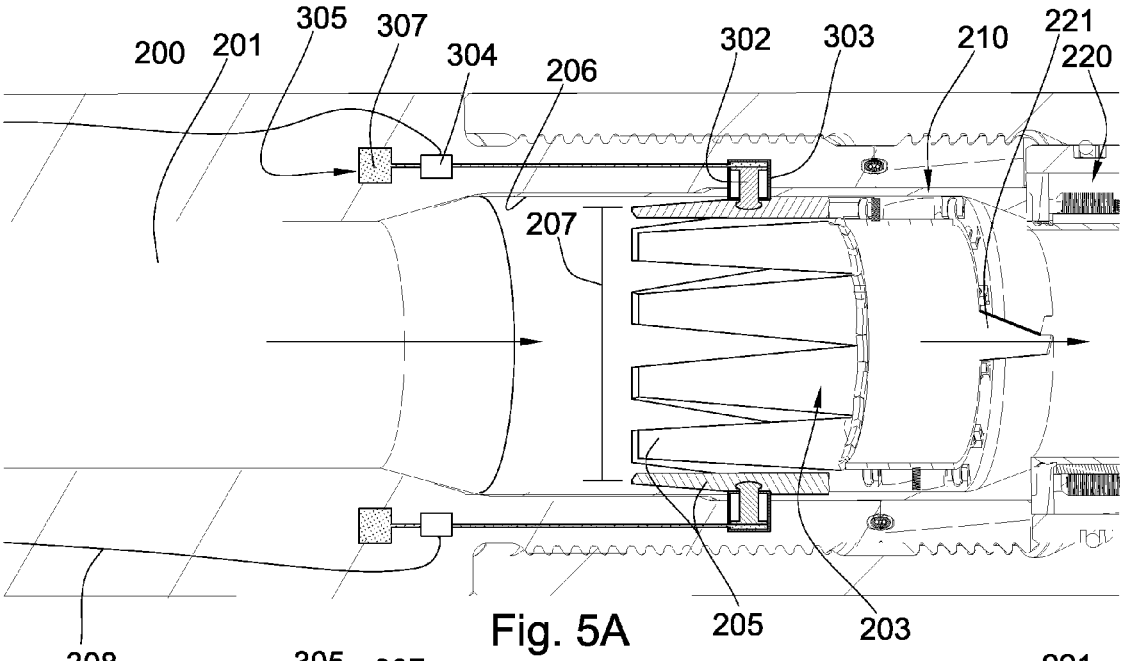
FIG. 5*a* is a cross-sectional diagram of another embodiment of the downhole tool string component in the opened position.
Figure 5B:
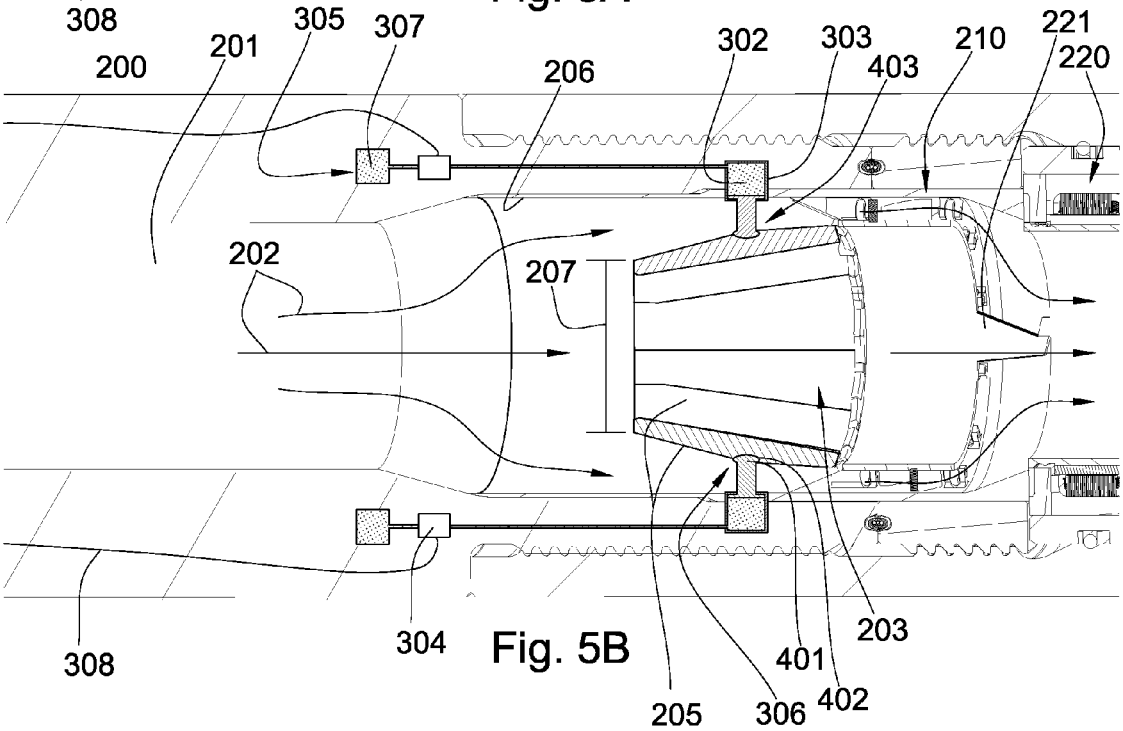
FIG. 5*b* is a cross-sectional diagram of another embodiment of the downhole tool string component in the closed position.

Referring now to FIGS. 5*a* through 5*b*, the at least two movable segments 205 are adapted to pivot on the opening mechanism 260. The distal end 306 of the piston 302 may comprise a spherical geometry 401 adapted to fit within a recess 402 formed in the at least two movable segments 205. The spherical geometry 401 of the distal end 306 and the recess 402 in the at least two movable segments 205 may form a ball-and-socket joint 403 wherein the at least two movable segments 205 may pivot on the distal end 306 of the piston 302.

Figure 6A:
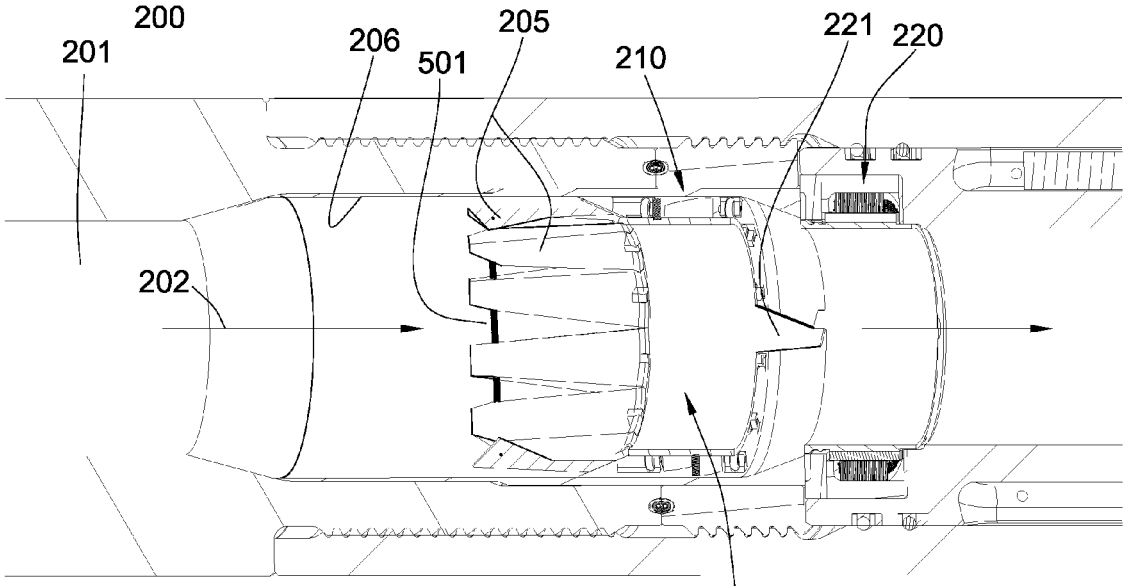
FIG. 6*a* is a cross-sectional diagram of another embodiment of the downhole tool string component in the opened position.
Figure 6B:
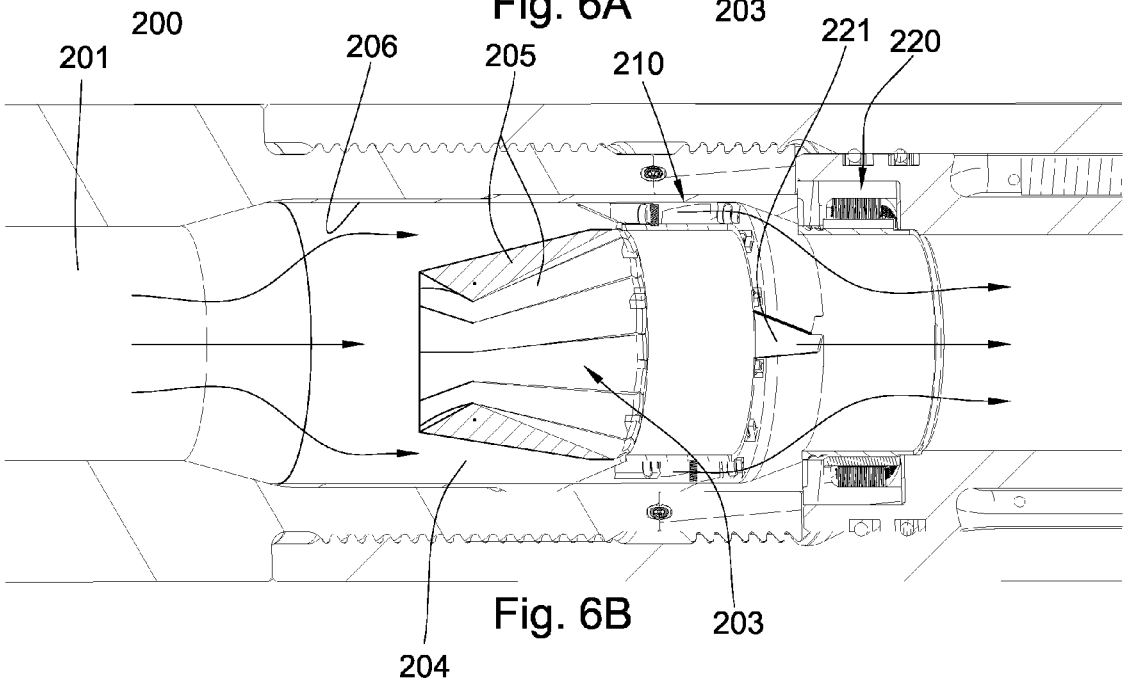
FIG. 6*b* is a cross-sectional diagram of another embodiment of the downhole tool string component in the closed position.

Referring now to the embodiment of FIGS. 6*a* through 6*b*, springs 501 may connect the at least two movable segments 205 together. The springs 501 may be used to move the at least two movable segments 205 apart from each other into the opened position. The springs 501 may exert a force strong enough to keep the at least two movable segments 205 in the opened position when drilling mud 202 is not flowing through the bore 201 and weak enough to allow the at least two movable segments 205 to move to the closed position when drilling mud 202 is flowing through the bore 201. The springs 501 may be used to move the at least two movable segments 205 together into the closed position. The at least two movable segments 205 may comprise a forward tapered face 502. It is believed that the forward tapered face 502 may be beneficial when instruments from the surface are passed down the center of the drill string 100 and as the instruments approach the at least two movable segments 205 the instruments will contact the forward tapered face 502 of the at least two movable segments 205 which will direct the instruments towards the central passage 203. The at least two movable segments 205 may comprise a rearward tapered face 503. It is believed that the rearward tapered face 502 may be beneficial when instruments from the surface that have been passed down the center of the drill string 100 and the downhole component 200 are being raised back up to the surface and as the instruments approach the at least two movable segments 205 the instruments will contact the reward tapered face 503 of the at least two movable segments 205 which will direct the instruments towards the central passage 203 and may assist the instruments in moving the at least two movable segments 205 to the opened position if the at least two movable segments 205 are in the closed position.

Figure 7A:
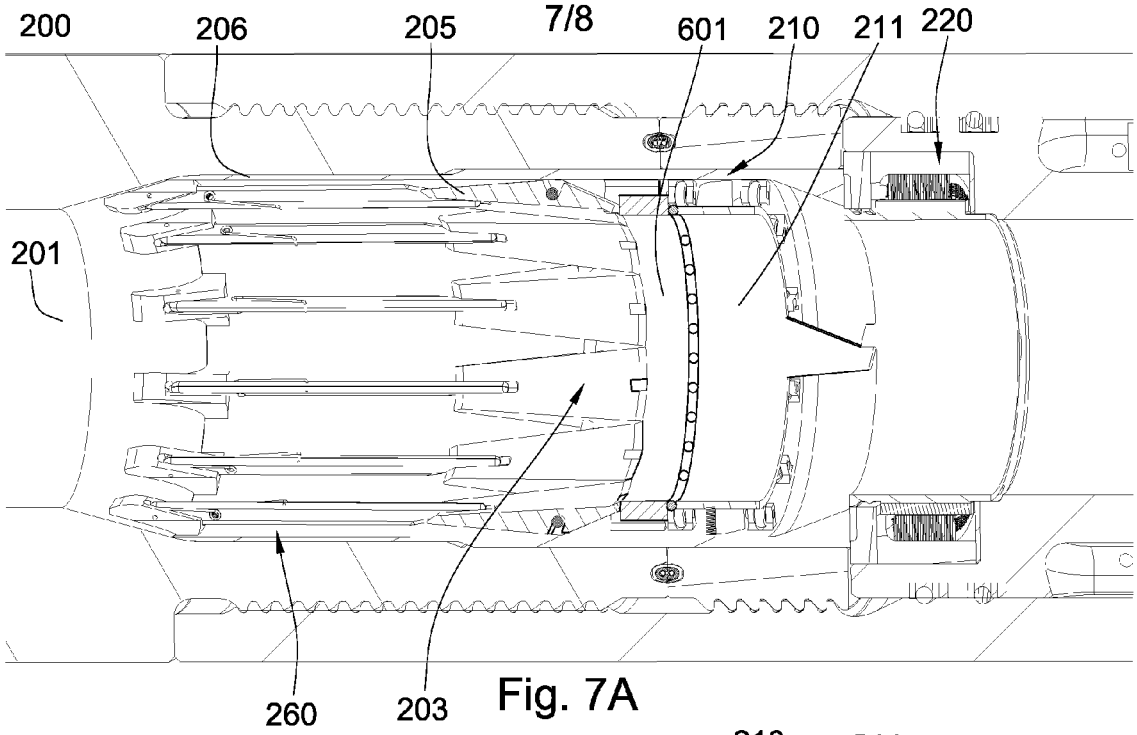
FIG. 7*a* is a cross-sectional diagram of another embodiment of the downhole tool string component in the opened position.
Figure 7B:
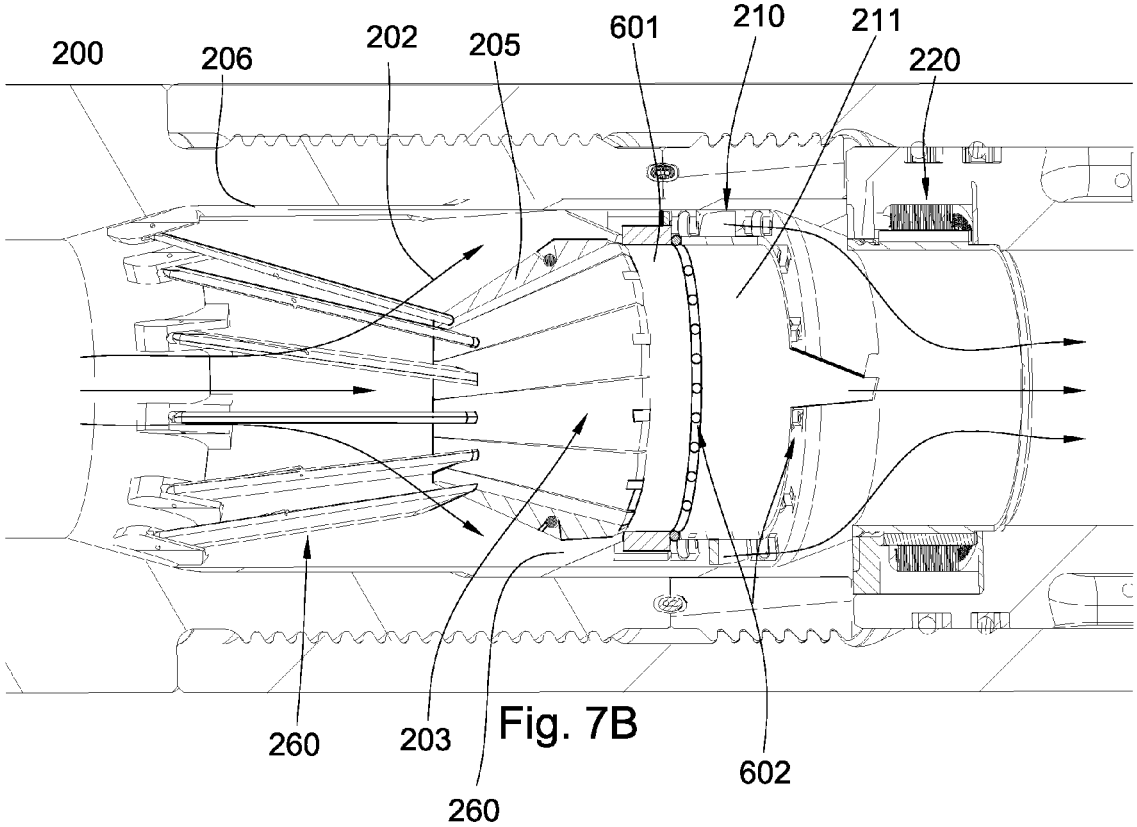
FIG. 7*b* is a cross-sectional diagram of another embodiment of the downhole tool string component in the closed position.

Referring now to FIGS. 7*a* through 7*b*, a stator 601, the turbine body 211 and the at least two movable segments 205 may form the barrier 209 separating the central passage 203 and the at least one periphery passage 204. The stator 601 may be disposed intermediate the turbine body 211 and the at least two movable segments 205 and at least two movable segments 205 may be adapted to pivot on the stator 601. Bearings 602 may be disposed intermediate the turbine body 211 and the stator 601. Bearings 602 may also be disposed intermediate the turbine body 211 and the bore wall 206.

Figure 8:
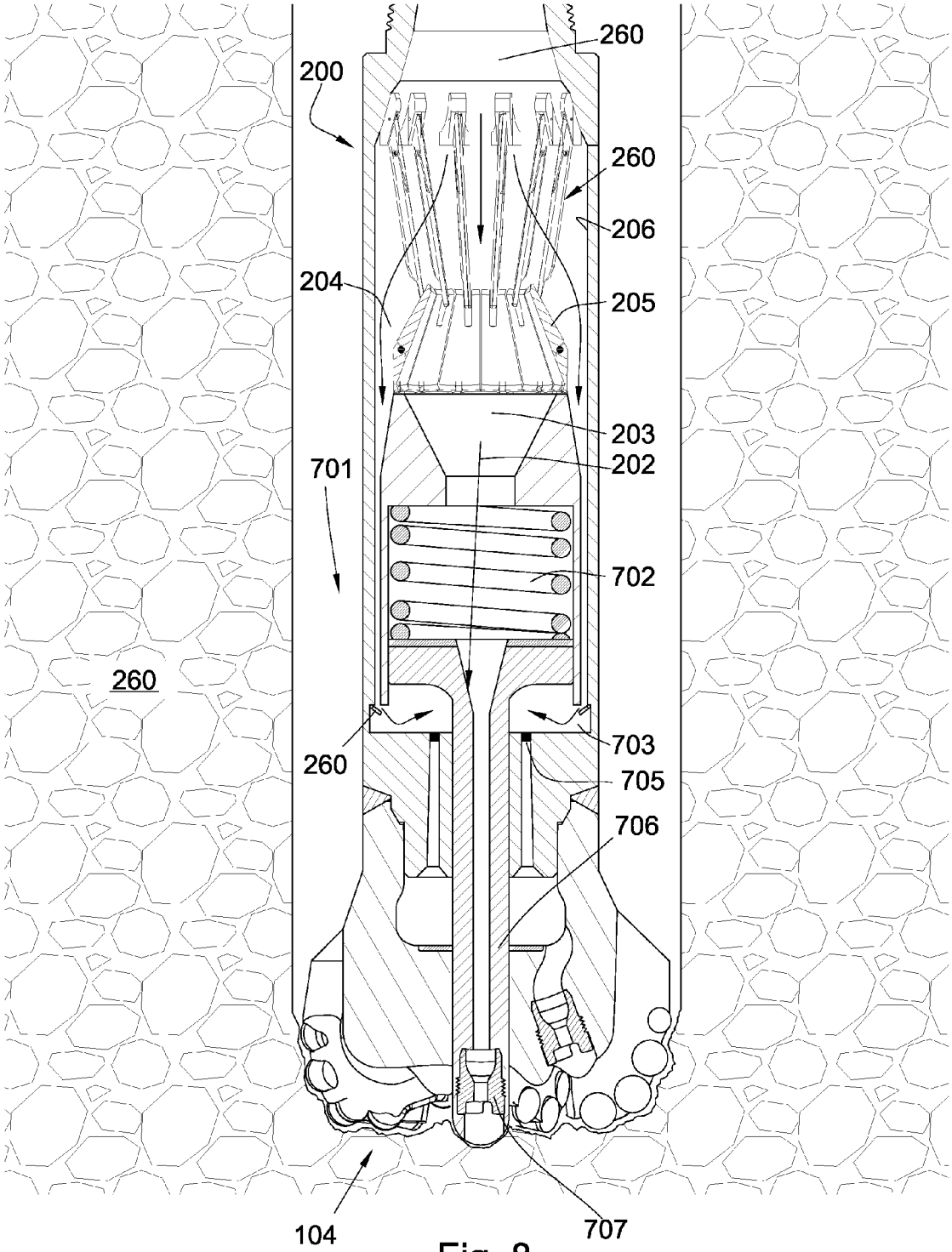
FIG. 8 is a sectional diagram of an embodiment of a portion of the downhole assembly.

The at least one periphery passage 204 may direct drilling mud to a downhole hammer, a downhole steering tool, sensors, or combinations thereof. Referring now to FIG. 8, the at least one periphery passage 204 may direct drilling mud to a downhole hammer 701. The downhole hammer 701 may comprise a loading spring 702, fluid chamber 703, entry valves 704, exit valves 705, and a hammer head 706. The at least one periphery passage 204 may direct drilling mud 202 to the entry valves 704 and into the fluid chamber 703. As the fluid chamber 703 fills, pressure in the fluid chamber 703 compresses the loading spring 702. After the loading spring 702 is compressed, the exit valves 705 are opened allowing the drilling mud 202 to exit the fluid chamber 703 and the loading spring 702 pushes the hammer head 706 against the formation 105. The central passage 203 may direct drilling mud 202 to a nozzle 707.

Whereas the present invention has been described in particular relation to the drawings attached hereto, it should be understood that other and further modifications apart from those shown or suggested herein, may be made within the scope and spirit of the present invention.

What is claimed is:

1. A downhole assembly, comprising:

a downhole tool string component comprising a bore adapted to accommodate drilling mud comprising a central passage and at least one periphery passage;

at least two movable segments peripherally positioned around a bore wall adapted to constrict a diameter of the central passage adapted to divert drilling mud into the at least one periphery passage; and at least one opening mechanism adapted to move a portion of the at least two movable segments toward the bore wall;

wherein a turbine body disposed within the bore and the at least two movable segments form a barrier separating the central passage and the at least one periphery passage.

2. The downhole assembly of claim 1, wherein the at least one periphery passage directs drilling mud to a turbine.

3. The downhole assembly of claim 2, wherein the turbine is in communication with an electrical generator.

4. The downhole assembly of claim 1, wherein the at least one periphery passage directs drilling mud to a downhole hammer, a downhole steering tool, sensors, or combinations thereof.

5. The downhole assembly of claim 1, wherein the at least one opening mechanism comprises a motor, a spring, a pin, a hydraulic actuator, or combinations thereof.

6. The downhole assembly of claim 1, wherein the at least two movable segments are interlocked.

7. The downhole assembly of claim 1, wherein springs connect the at least two movable segments together.

8. The downhole assembly of claim 7, wherein the springs are adapted to move the at least two movable segments closer to each other.

9. The downhole assembly of claim 1, wherein the downhole assembly is in communication with a telemetry system.

10. The downhole assembly of claim 1, wherein the at least two movable segments are foils.

11. The downhole assembly of claim 1, wherein the at least two movable segments comprise a forward tapered face.

12. The downhole assembly of claim 1, wherein the at least two movable segments comprise a rearward tapered face.

13. The downhole assembly of claim 1, wherein an edge of the at least two movable segments tapers from a bottom end of the at least two movable segments to a top end of the at least two movable segments.

14. The downhole assembly of claim 1, wherein the bore comprises an expanded diameter region.

15. The downhole assembly of claim 1, wherein the at least two movable segments are adapted to pivot on the opening mechanism.

16. The downhole assembly of claim 1, wherein the at least two movable segments are adapted to pivot on a stator disposed within the bore.

17. The downhole assembly of claim 1, wherein the at least two movable segments are adapted to pivot on a wall of the at least one periphery passage.

18. The downhole assembly of claim 1, wherein the at least two movable segments close the at least one periphery passage.

* * * * *